US012117003B2

(12) United States Patent
Alsundkar et al.

(10) Patent No.: US 12,117,003 B2
(45) Date of Patent: Oct. 15, 2024

(54) FLEXIBLE CRESCENT FOR LOW PRESSURE FUEL PUMP

(71) Applicant: Cummins Inc., Columbus, IN (US)

(72) Inventors: Amol Yashwant Alsundkar, Pune (IN); Senthil Kumar Selvaraj, Chennai (IN); Nitin Khojare, Amravati (IN); Rashmi Prakash Keskar, Pune (IN); Jayesh Mahadev Gudekar, Pune (IN)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/785,865

(22) PCT Filed: Dec. 14, 2020

(86) PCT No.: PCT/US2020/064852

§ 371 (c)(1),
(2) Date: Jun. 15, 2022

(87) PCT Pub. No.: WO2021/126766

PCT Pub. Date: Jun. 24, 2021

(65) Prior Publication Data

US 2024/0011481 A1 Jan. 11, 2024

(30) Foreign Application Priority Data

Dec. 17, 2019 (IN) ..... 201911052427

(51) Int. Cl.
*F04C 2/10* (2006.01)
*F04C 15/06* (2006.01)

(52) U.S. Cl.
CPC ..... *F04C 2/101* (2013.01); *F04C 15/06* (2013.01); *F04C 2210/203* (2013.01)

(58) Field of Classification Search
CPC ..... F04C 2/101; F04C 15/06
See application file for complete search history.

(56) References Cited

U.S. PATENT DOCUMENTS 3,679,335 A 7/1972 Zippel
3,785,756 A 1/1974 Langenderfer
(Continued)

FOREIGN PATENT DOCUMENTS

DE 1403923 11/1969
DE 102007049704 4/2009
(Continued)

OTHER PUBLICATIONS

German patent publication and Machine translation of DE 102014217049 A1, inventor: Brunner, Title: Internal Gear Pump; Published: Mar. 3, 2016. (Year: 2016).*
(Continued)

*Primary Examiner* — Mary A Davis
(74) *Attorney, Agent, or Firm* — Taft, Stettinius & Hollister LLP

(57) ABSTRACT

A crescent member is disclosed which is configured to be in constant contact with outer and inner gear teeth to prevent unwanted fluid backflow between the gears. The crescent member may be part of a low-pressure fuel pump system for a diesel engine. In order to reduce heat buildup in the crescent member and gear teeth, the crescent member comprises a gap to allow fluid to flow within the crescent member to absorb and dissipate the heat generated by friction. The crescent member is resilient to maintain constant contact, but flexible enough to reduce wear from friction over time.

20 Claims, 8 Drawing Sheets

(56) References Cited

U.S. PATENT DOCUMENTS

| | | | |
|---|---|---|---|
| 4,132,514 | A | 1/1979 | Eckerle |
| 4,392,799 | A | 7/1983 | Shikano et al. |
| 7,625,192 | B2 | 12/2009 | Saito et al. |
| 7,766,634 | B2 | 8/2010 | Liavas et al. |
| 8,475,150 | B2 | 7/2013 | Kaeferstein et al. |
| 8,579,619 | B2 | 11/2013 | Schepp et al. |
| 9,028,232 | B2 | 5/2015 | Schepp et al. |
| 9,068,569 | B2 | 6/2015 | Speer et al. |
| 2005/0123419 | A1 | 6/2005 | Arbogast |
| 2014/0119973 | A1 | 5/2014 | Schepp et al. |
| 2015/0274141 | A1 | 10/2015 | Schepp et al. |
| 2018/0066520 | A1 | 3/2018 | Shkolnik et al. |

FOREIGN PATENT DOCUMENTS

| | | | |
|---|---|---|---|
| DE | 102012207254 | | 11/2013 |
| DE | 102012208851 | A1 | 11/2013 |
| JP | S51133804 | | 11/1976 |

OTHER PUBLICATIONS

German patent publication and Machine translation of DE 102012214356 A1, inventor: Schepp et al, Title: Internal Gear Pump; Published: Feb. 13, 2014. (Year: 2014).*

Chinese patent publication and Machine translation of CN 110273834 A, inventor: Goss, Title: Gear Fluid Machine; Published: Sep. 24, 2019. (Year: 2019).*

International Search Report and Written Opinion for International patent application No. PCT/US2020/064852, filed Dec. 14, 2020, mailed Mar. 18, 2021.

Extended European Search Report, Counter EP Application No. 20903615.1, Dated Nov. 22, 2023, 9 pgs.

* cited by examiner

FLEXIBLE CRESCENT FOR LOW PRESSURE FUEL PUMP

CROSS-REFERENCE TO RELATED APPLICATIONS

The present application claims the benefit of, and priority from, International Patent Application No. PCT/US2020/064852, filed Dec. 14, 2020, which claims priority to Indian Provisional Patent Application No. 201911052427, filed Dec. 17, 2019, which are incorporated by reference herein in their entirety.

FIELD OF THE DISCLOSURE

The present disclosure generally relates to a flexible crescent, more specifically a flexible crescent member within a low-pressure fuel pump between two gears.

BACKGROUND OF THE DISCLOSURE

Many vehicles on the road are powered by diesel engines, which utilize a fuel pump system where fuel is pumped from a low-pressure system to a high-pressure pump before entering the common rail and ultimately the engine through fuel injectors. Low-pressure fuel systems often use gear pumps, where the pressure of the fuel is increased by flowing the fuel through meshing gears. Such pumps often contain a crescent-shaped member located between two meshing gears to separate the fluid flow from the inlet to the outlet. However, as the fuel reaches higher pressures, radial back leakage often occurs where the fuel flows backwards through gaps between the teeth of the gears and the walls of the crescent member within the pump. This leakage reduces engine performance, especially at low speeds or cranking conditions. Back leakage can be reduced by machining the gears and pump walls to higher standards of accuracy, but increased precision in machining parts increases cost. Furthermore, wear between the metal surfaces of the pump causes high heat generation within the pump as well as friction welding between the gears and the pump walls or crescent. It is therefore desirable to reduce back leakage over a large range of pump operating speeds, while minimizing costs and metal wear.

SUMMARY OF THE INVENTION

A crescent member is disclosed which is configured to be in constant contact with outer and inner gear teeth to prevent unwanted fluid backflow between the gears. The crescent member may be part of a low-pressure fuel pump system for a diesel engine. In order to reduce heat buildup in the crescent member and gear teeth, the crescent member comprises a gap to allow fluid to flow within the crescent member to absorb and dissipate the heat generated by friction. The crescent member is resilient to maintain constant contact, but flexible enough to reduce wear from friction over time.

According to one embodiment, the present disclosure provides a fuel pump assembly comprising a fuel pump housing; an inner gear comprising inner gear teeth, rotatably coupled to the fuel pump housing; an outer gear comprising outer gear teeth, rotatably coupled to the fuel pump housing and configured to operably mesh with the inner gear; a retaining member coupled to the housing through at least one coupling member and located between the outer gear and the inner gear; a crescent member comprising at least one outer surface and a gap in the at least one outer surface configured to allow fuel to at least partially flow through the gap into the crescent member, the crescent member being coupled to an outer surface of the retaining member and flexible such that a force applied to the crescent by the inner gear teeth or the outer gear teeth causes the crescent member to flex; an inlet that allows fuel to enter the fuel pump assembly; and an outlet that allows fuel to leave the fuel pump assembly, wherein the fuel enters the fuel pump through the inlet, increases in pressure due to at least the rotation of the inner gear, and leaves the fuel pump through the outlet.

According to another embodiment, the present disclosure provides a pump, comprising an outer gear; an inner gear disposed within the outer gear and configured to rotate, thereby causing rotation of the outer gear; a housing configured to receive the inner gear and the outer gear, the housing having an inlet in flow communication with a passage between the inner gear and the outer gear and an outlet in flow communication with the passage; a flexible curved spacer coupled to the housing and disposed within the passage, the flexible curved spacer having an outer surface biased into contact with the inner gear and the outer gear to inhibit fluid from flowing through the passage in a direction opposite a direction of rotation of the inner gear and the outer gear.

According to yet another embodiment, the present disclosure provides a pump assembly comprising a pump housing; an inner gear rotatably coupled to the pump housing; an outer gear rotatably coupled to the pump housing and configured to operably mesh with the inner gear; a flexible crescent member coupled to the pump housing through a retaining member, the crescent member positioned between the inner gear and the outer gear and configured to interface with the inner gear and the outer gear; an inlet disposed within the pump housing and configured to allow a fluid to enter the pump assembly; and an outlet disposed within the pump hosing and configured to allow the fluid to leave the pump assembly, wherein rotation of the inner gear and the outer gear drives the fluid from the inlet to the outlet past the flexible crescent member.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the disclosure and such exemplifications are not to be construed as limiting the scope of the disclosure in any manner.

DETAILED DESCRIPTION OF EMBODIMENTS OF THE DISCLOSURE

Figure 1:
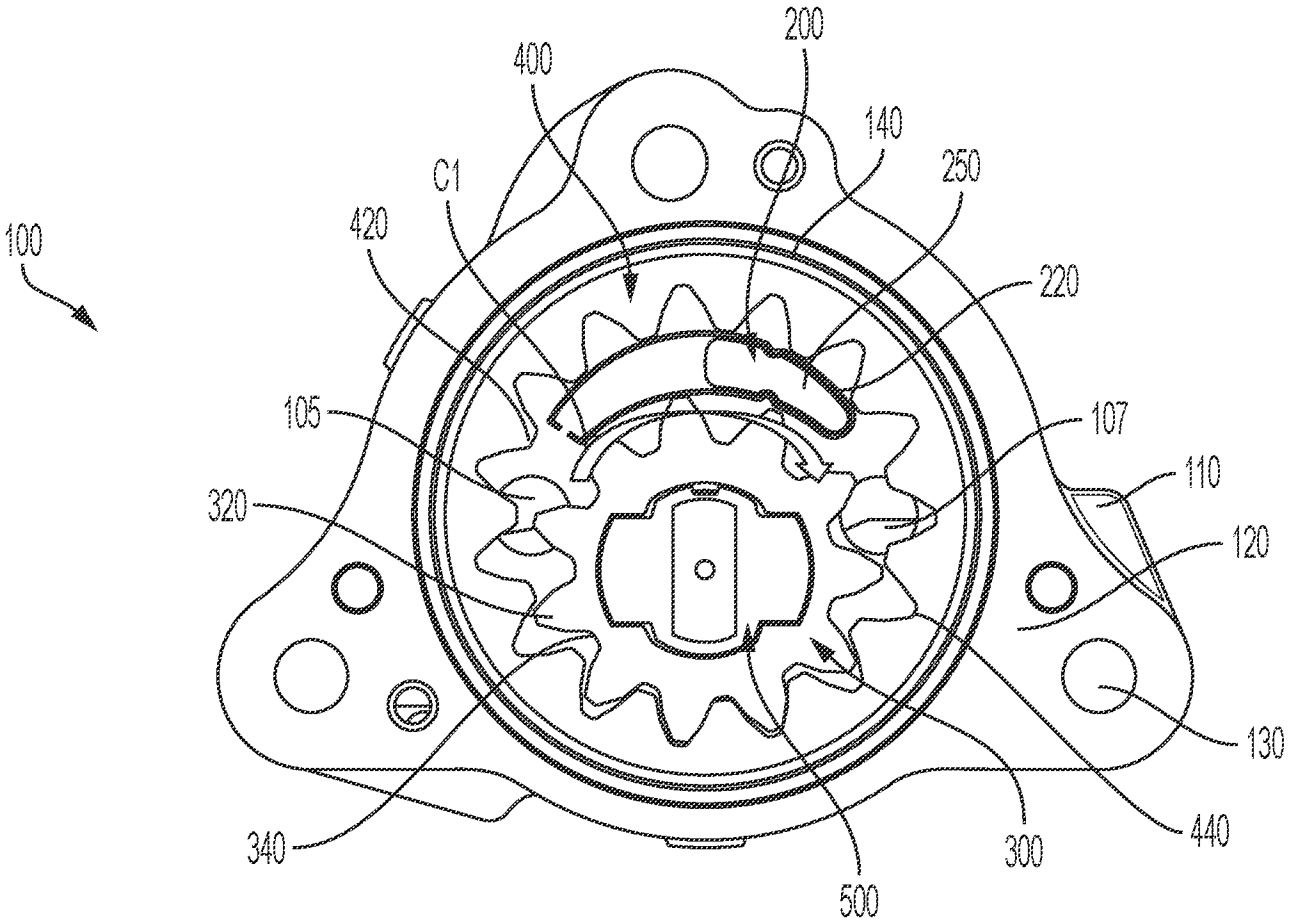
FIG. 1 is a front view of a fuel pump according to an embodiment of the present disclosure.
Figure 2:
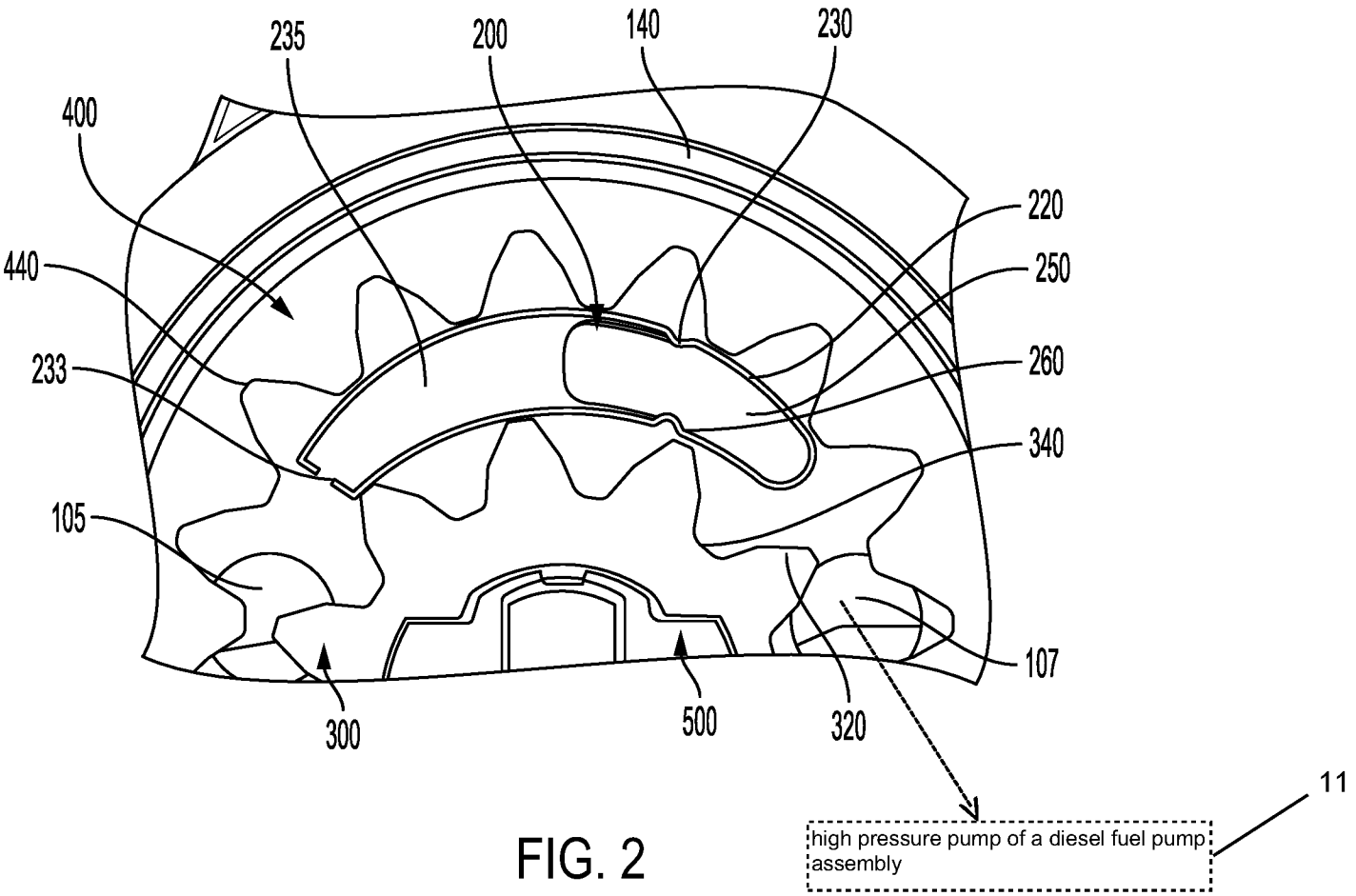
FIG. 2 is a partial front view of the fuel pump of FIG. 1.

Referring to FIGS. 1 and 2, in the illustrated embodiment crescent assembly 200 lies between an inner gear 300 and an outer gear 400 of a low-pressure fuel pump (LPP) 100, for example, in a system including a diesel engine (not shown). In the illustrated embodiment, low-pressure fuel pump 100 is a gear pump. A torque is applied to inner gear 300 through coupling 500 from an upstream drive train, which causes the rotation of inner gear 300. Fuel flows into the LPP 100 through an inlet 105 and travels in the clockwise direction C1 to an outlet 107. Fuel flows from outlet 107 to a high-pressure fuel pump 11 before entering an accumulator (e.g. common rail) for delivery to the engine cylinders by the fuel injectors.

The housing 110 of the LPP 100 comprises a connecting face 120, housing connecting members 130, sealing gasket 140, fuel inlet 105, and fuel outlet 107. Connecting face 120 and sealing gasket 140 are configured to interface with a face of a high-pressure fuel pump (not shown) through at least housing connecting members 130. LPP 100 is also configured to receive fuel through fuel inlet 105 where the fuel can be pressurized before exiting through fuel outlet 107. In the illustrated embodiment, LPP 100 is a gear pump, where the pressure of the fuel is increased by compression between at least outer gear 400, inner gear 300, and crescent assembly 200.

Figure 3:
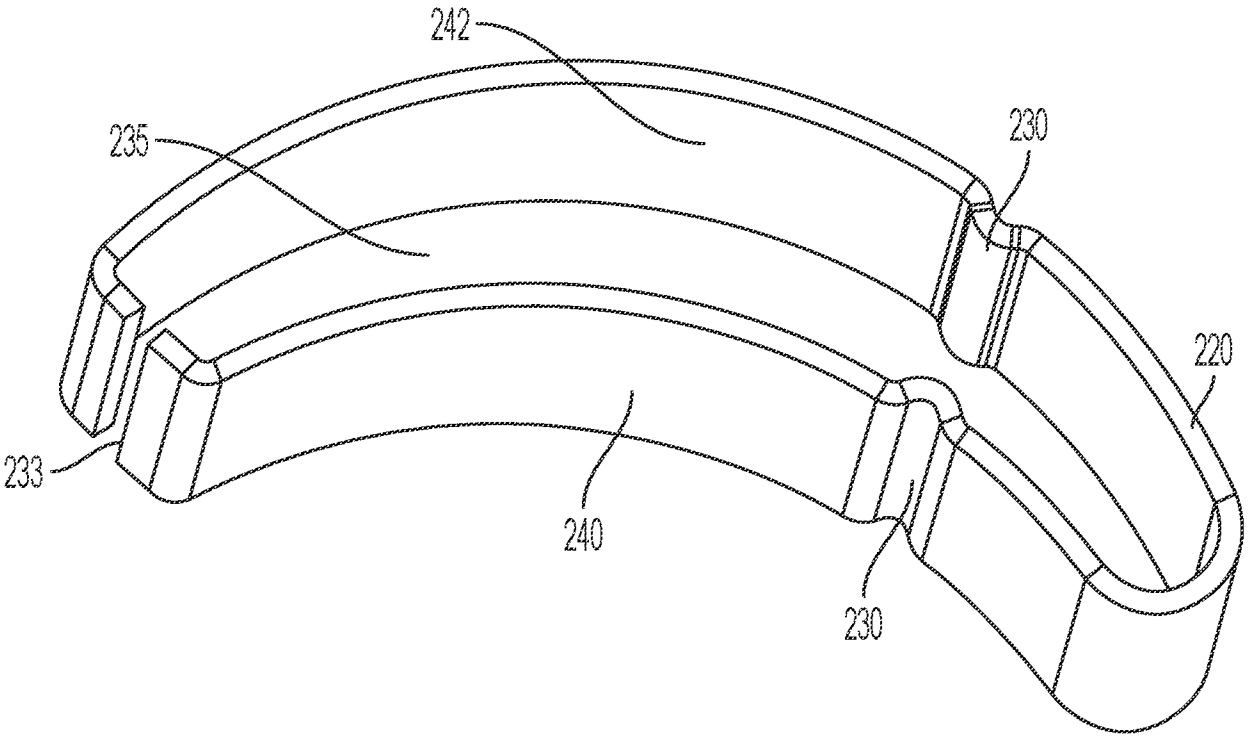
FIG. 3 is a perspective view of a crescent according to an embodiment of the present disclosure.
Figure 4:
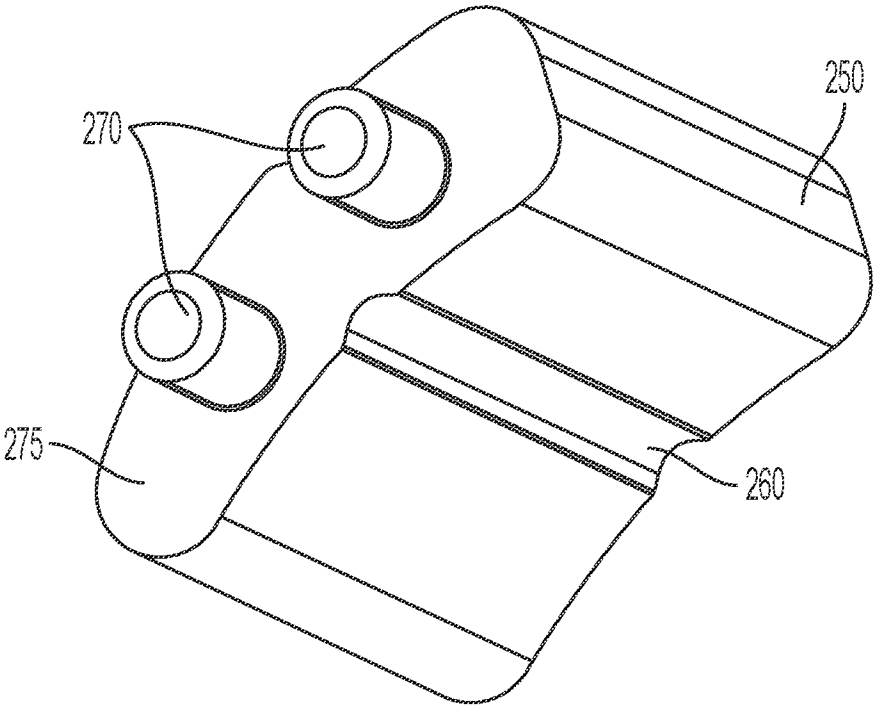
FIG. 4 is a perspective view of a crescent retainer according to an embodiment of the present disclosure.

Referring to FIGS. 3-4, crescent assembly 200 comprises a crescent member 220 and a retaining member 250. Crescent member 220 comprises an outer surface 240, an inner surface 242, crescent indents 230, a gap 233, and an inner space 235. It should be understood that crescent member 220 need not necessarily be formed in the shape of a crescent. In alternative embodiments, member 220 may be shortened but still have curved inner and outer surfaces. Moreover, member 220 may be referred to as a "crescent member" in certain embodiments and "curved spacer" in other embodiments. At least a portion of retaining member 250 is configured to interface with at least a portion of the inner surface 242 of crescent member 220. In the illustrated embodiment, crescent indents 230 are configured to couple with retaining indents 260 to fix crescent member 220 to retaining member 250 such that crescent member 220 is restricted from moving at least in the direction of C1 or in a direction opposite to C1 (see FIG. 1). In the illustrated embodiment, two crescent indents 230 and retaining indents 260 are shown, but in other embodiments any number of crescent indents 230 and retaining indents 260 may be used. When coupled to crescent member 220, retaining member 250 fills part of inner space 235. Furthermore, in the illustrated embodiment crescent member 220 is removably coupled to retaining member 250. Crescent member 220 can be coupled or decoupled to retaining member 250 through motion in a direction parallel to A1. In other words, crescent member 220 can be slid over retaining member 250. In other embodiments, crescent member 220 may be coupled to retaining member through adhesives, welds, fasteners, or other coupling means. When the retaining member 250 is coupled to the housing 110, the coupling between the crescent member 220 and retaining member 250 operably couples crescent member 220 to housing 110. The crescent member 220 and the retaining member 250 may be composed of a metal, a polymer, a polymer coated metal, or any other substance capable of providing desired material properties.

Figure 7:
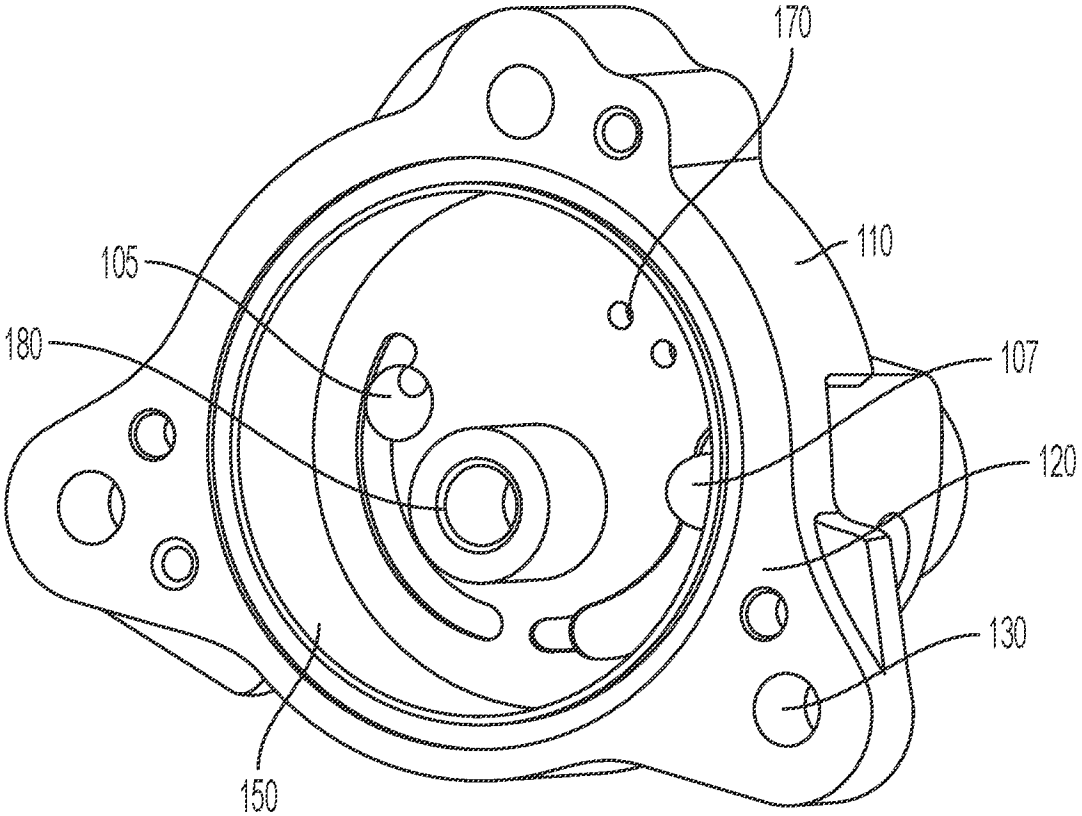
FIG. 7 is a perspective view of the housing of the fuel pump according to FIG. 1.

Gap 233 is located at a first end of crescent member 220 near fuel inlet 105 allows fuel to enter and exit at least a portion of inner space 235. Retaining member 250 further comprises at least one coupling member 270 to couple retaining member 250 to housing 110 through at least one housing coupling member 170 (FIG. 7). In the illustrated embodiments, coupling members 270 are protrusions or posts, and housing coupling members 170 are recesses or bores configured to receive coupling members 270. This reduces the machining required to produce housing 110. In other embodiments, coupling members 270 may be recesses, and housing coupling members 170 may be protrusions. In still other embodiments, retaining member 250 and housing 100 may have any number or type of coupling members 270 and housing coupling members 170 respectively. Retaining member 270 may also be coupled to housing 100 through screws, welds, adhesives, rivets, bolts, or other coupling means. In such embodiments, housing 110 may not comprise housing coupling members 170.

Figure 5:
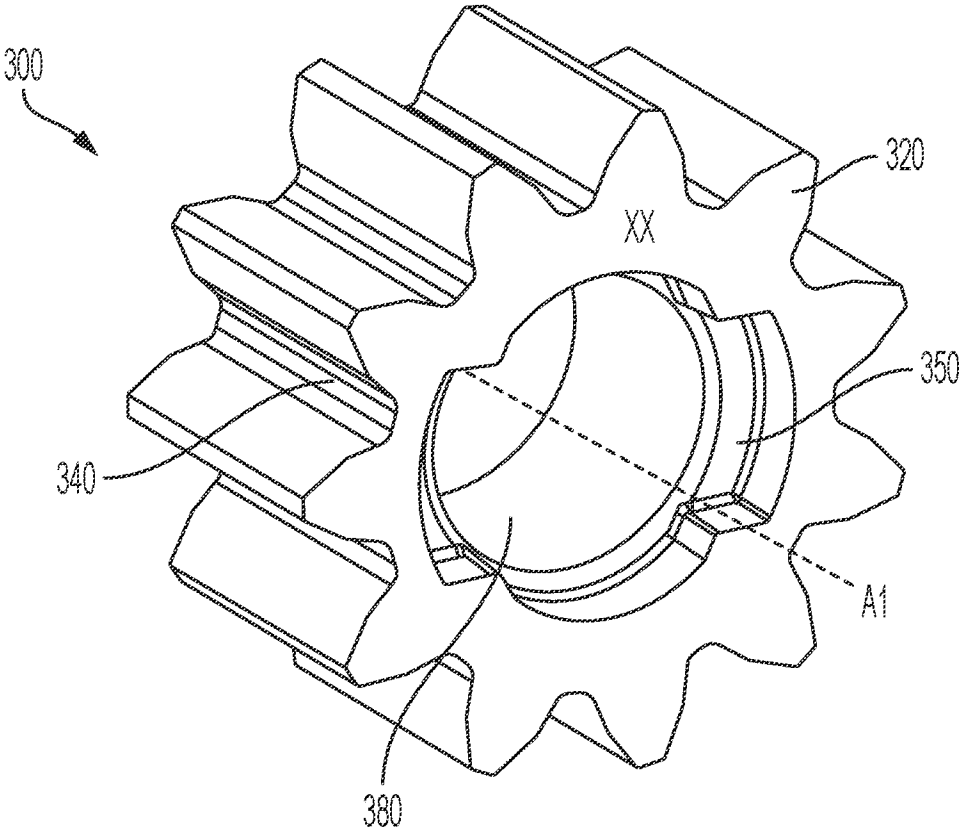
FIG. 5 is a perspective view of an inner gear according to an embodiment of the present disclosure.
Figure 6:
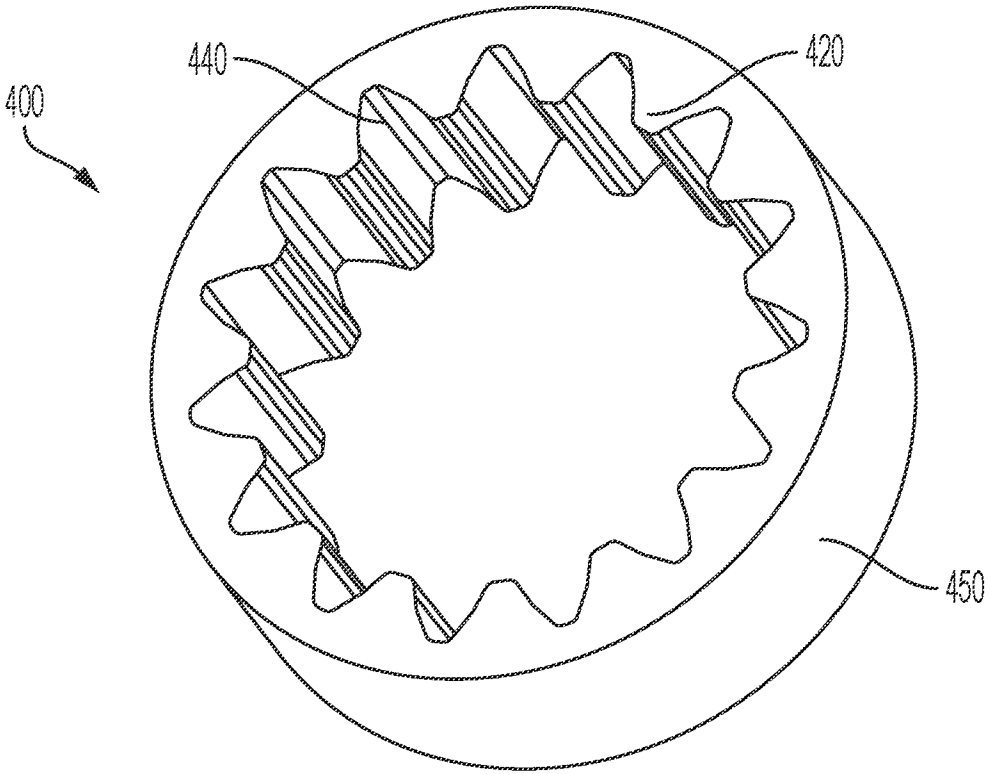
FIG. 6 is a perspective view of an outer gear according to an embodiment of the present disclosure.

Referring now to FIGS. 5-6, LPP 100 further comprises inner gear 300 and outer gear 400. Inner gear 300 includes inner gear teeth 320, inner gear grooves 340, coupling slot 350, and inner bore 380. Coupling 500 (see FIG. 1) is configured to transmit a torque to inner gear 300 through coupling slot 350. An exemplary torque delivery system is described in India patent application entitled "COUPLING BETWEEN A PUMP CAM SHAFT AND A GEAR," (Serial Number 201911043152) filed on Oct. 23, 2019, which is hereby incorporated herein in its entirety. Outer gear 400 comprises outer gear teeth 420, outer gear grooves 440, and outer gear surface 450. Inner gear 300 and outer gear 400 are configured such that inner gear teeth 320 mesh with outer gear grooves 440, and outer gear teeth 420 mesh with inner gear grooves 340. Accordingly, inner gear 300 is operably coupled to outer gear 400 such that rotation of inner gear 300 about axis A1 causes rotation of outer gear 400. Inner gear 300 and outer gear 400 couple together such that there is a gap created to accommodate the insertion of crescent assembly 200. Inner gear 300 and outer gear 400 may be composed of a metal, polymer, polymer coated metal, metal coated polymer, or any other composition with desirable material properties.

Figure 8:
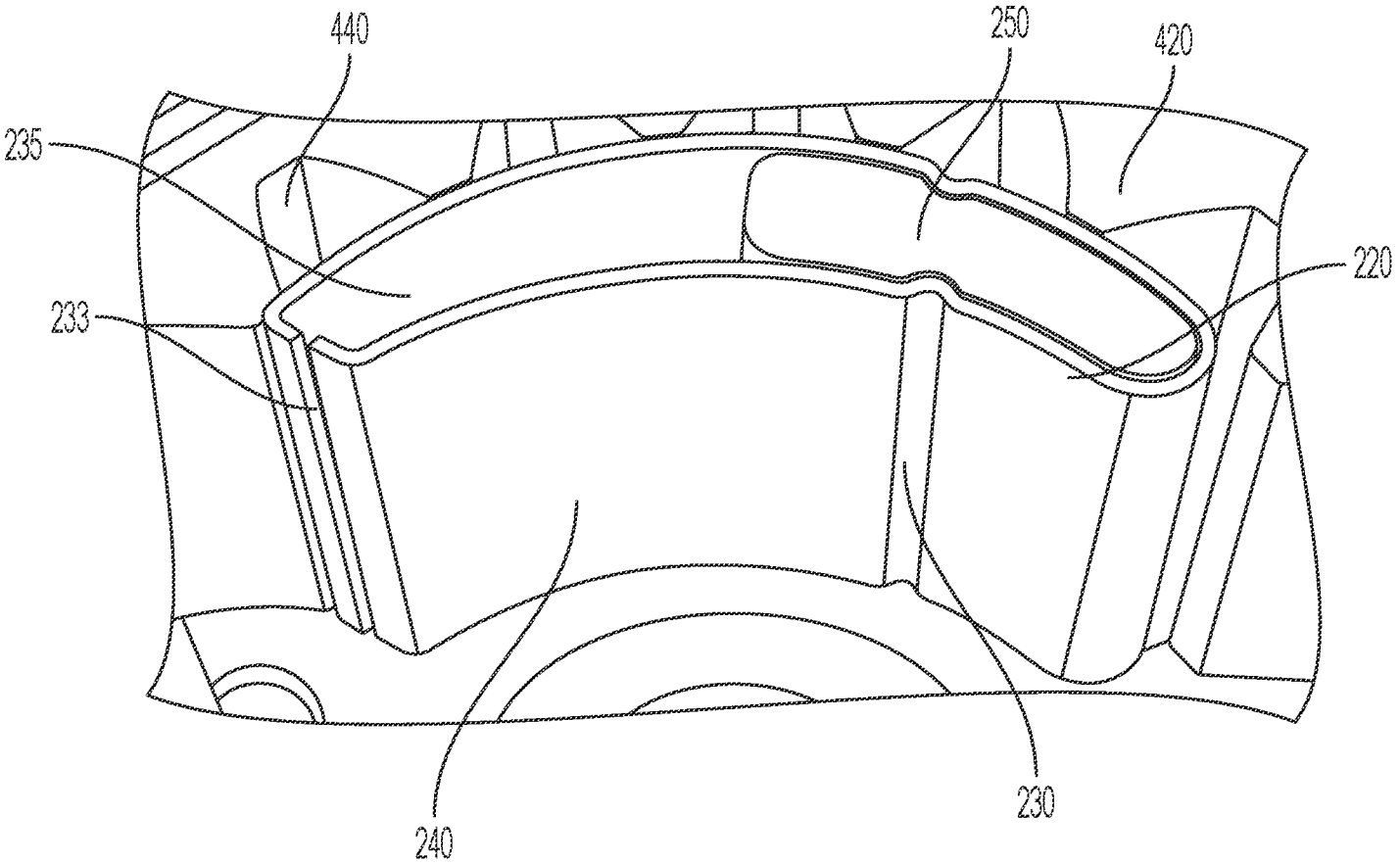
FIG. 8 is a partial perspective view of the fuel pump according to FIG. 1 without the inner gear.

Referring to FIGS. 7-8, fuel pump housing 110 further comprises a housing post 180 to operably couple with inner bore 380 of inner gear 300. LPP 100 is assembled by inserting inner gear 300 around housing post 180, inserting outer gear 400 into housing 110 such that the outer gear surface 450 interfaces with an inner housing surface 150 and the outer gear 400 operably couples to inner gear 300. Crescent assembly 200 is inserted into the gap between inner gear 300 and outer gear 400 by inserting coupling members 270 into housing coupling members 170.

Referring again to FIGS. 1-2, in operation, fuel enters LPP 100 through fuel inlet 105, and flows between inner gear 300 and outer gear 400. Gasket 140 lies against faceplate 120 to prevent fuel from leaving LPP 100. The rotation coupling 500 causes the rotation of inner gear 300 which pushes fuel in the direction of C1, so that the fuel is located between the crescent member 220 and either inner gear grooves 340 or outer gear grooves 440. Inner gear teeth 320 and outer gear teeth 420 each press against crescent member 220, causing crescent member 220 to flex in response to the applied force. The flexibility of crescent member 220 allows inner and outer gear teeth 320 and 420 to directly contact the outer surface 240 of crescent member 220 without causing excessive material wear over time. Crescent indents 230 prevent the motion of crescent member 220 while the pump is in use. Crescent member 220 is also resilient, such that crescent member 220 presses back against inner and outer gear teeth 320 and 420. In this way, inner and outer gear teeth 320 and 420 can be in constant contact with crescent member 220 to reduce backflow, especially at lower speeds. Because the components can be in constant contact and crescent member 220 has the ability to flex, the components within LPP 100 can be machined with less precise dimensioning requirements.

Fuel can also flow into the inner space 235 of crescent assembly 200 through gap 233. When the inner and outer gear teeth 320 and 420 rub against outer surface 240 of crescent member 220, the friction from contact generates heat which could result in friction welding or component wear over time. However, the fuel located in inner space 235 assists in absorbing and dissipating at least some of the heat generated by friction. This allows for a tight seal to be made between inner and outer gear teeth 320 and 420 and crescent member 220 such that the fuel in LPP 100 does not flow opposite the intended direction of motion during operation (i.e. backflow or radial leakage). The pressurized fuel is then pushed out of fuel outlet 107 to be sent to another portion of the fuel pump system, or another part of the vehicle. LPP 100 can be connected to other portions of a fuel-pump assembly such as a high-pressure pump through connection members 130.

While the operation of LPP 100 is described above with rotation of inner gear 300 in the clockwise direction of C1, it should be understood that LPP 100 may also operate in a counter-clockwise direction. In such an embodiment, fuel inlet 105 and fuel outlet 107 would be reversed, retaining member 250 would be flipped and positioned on the left side of LPP 100 (as viewed in FIG. 1), and crescent member 220 would be correspondingly flipped and positioned onto retaining member 250. It should also be understood that in certain embodiments, crescent member 220 may be welded or otherwise fixedly attached to retaining member 250 such that the components function as one piece. In such embodiments, retaining member 250 may not comprise retaining indents 260, and crescent member 220 may not comprise crescent indents 230. Furthermore, in such embodiments, the assembly may be more robust and resistant to fretting failure of crescent member 220.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more."

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

Systems, methods and apparatus are provided herein. In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic with the benefit of this disclosure in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A fuel pump assembly comprising:

a fuel pump housing, an inner gear comprising inner gear teeth, rotatably coupled to the fuel pump housing;

an outer gear comprising outer gear teeth, rotatably coupled to the fuel pump housing and configured to operably mesh with the inner gear;

a retaining member having a body, comprising at least one coupling member protruding from the body and at least one retaining indent on an outer surface of the body, the retaining member directly coupled to the fuel pump housing through the at least one coupling member and located between the outer gear and the inner gear;

a crescent member comprising at least one outer surface and a gap in the at least one outer surface configured to allow fuel to at least partially flow through the gap into the crescent member, the crescent member being coupled to the outer surface of the retaining member and including at least one protruding indent at an inner surface thereof to interface with the at least one retaining indent of the retaining member, the crescent member being flexible such that a force applied to the crescent by the inner gear teeth or the outer gear teeth causes the crescent member to flex;

an inlet that allows fuel to enter the fuel pump assembly; and an outlet that allows fuel to leave the fuel pump assembly, wherein the fuel enters the fuel pump through the inlet, increases in pressure due to at least the rotation of the inner gear, and leaves the fuel pump through the outlet.

2. The fuel pump assembly of claim 1, wherein the at least one retaining indent of the retaining member is configured to receive the at least one protruding indent of the crescent member to couple the crescent member to the retaining member, wherein the coupling of the crescent member to the retaining member fixes the crescent member to the retaining member to restrict movement of the crescent member in one or more directions.

3. The fuel pump assembly of claim 1, wherein the at least one coupling member is a protruding member that is inserted into at least one recess in the fuel pump housing.

4. The fuel pump assembly of claim 1, wherein the crescent member and retaining member are individually composed of at least one of a metal, polymer, and polymer coated metal.

5. The fuel pump assembly of claim 1, further comprising a coupling to engage the inner gear to deliver a torque to the inner gear.

6. The fuel pump assembly of claim 1, wherein the fuel pump assembly is to be used with a diesel engine of a vehicle.

7. A pump, comprising:

an outer gear;

an inner gear disposed within the outer gear and configured to rotate, thereby causing rotation of the outer gear;

a housing configured to receive the inner gear and the outer gear, the housing comprising an inlet in flow communication with a passage between the inner gear and the outer gear and an outlet in flow communication with the passage;

a retaining member having a body and comprising at least one post protruding from the body and at least one complimentary indent, the retaining member directly coupled to the housing through the at least one post; and a flexible curved spacer coupled to the housing through the retaining member and disposed within the passage, the flexible curved spacer comprising, an outer surface biased into contact with the inner gear and the outer gear to inhibit fluid from flowing through the passage in a direction opposite a direction of rotation of the inner gear and the outer gear, a first end disposed proximate the inlet, a second end disposed proximate the outlet, and a gap within the first end configured to permit fluid flow into an interior space of the flexible curved spacer.

8. The pump of claim 7 wherein the fluid flow into the interior space of the flexible curved spacer is configured to absorb heat from the flexible curved spacer generated by contact with the inner gear and the outer gear.

9. The pump of claim 7 wherein the flexible curved spacer is removably coupled to the retaining member.

10. The pump of claim 9 wherein the retaining member includes the at least one post and the housing includes at least one bore configured to receive the at least one post to couple the retaining member to the housing.

11. The pump of claim 9 wherein the flexible curved spacer comprises at least one indent, and the retaining member comprises the at least one complimentary indent, the at least one indent in the flexible curved spacer configured to interface with the at least one complimentary indent in the retaining member.

12. The pump of claim 7 wherein the flexible curved spacer is fixedly coupled to the retaining member, and the retaining member and the flexible curved spacer are configured to function as one piece.

13. The pump of claim 7 wherein the outlet is fluidly coupled to a high pressure pump of a diesel fuel pump assembly.

14. A pump assembly comprising:

a pump housing;

an inner gear rotatably coupled to the pump housing;

an outer gear rotatably coupled to the pump housing and configured to operably mesh with the inner gear;

a continuous flexible crescent member coupled to the pump housing through a retaining member, the flexible crescent member positioned between the inner gear and the outer gear and configured to interface with the inner gear and the outer gear, the retaining member having a retaining indent on an outer surface thereof to interface with a protruding indent of the flexible crescent member;

an inlet disposed within the pump housing and configured to allow a fluid to enter the pump assembly; and an outlet disposed within the pump housing and configured to allow the fluid to leave the pump assembly, wherein rotation of the inner gear and the outer gear drives the fluid from the inlet to the outlet past the flexible crescent member.

15. The pump assembly of claim 14 wherein the retaining member is coupled to the housing through at least one of screws, rivets, bolts, welds, and adhesives.

16. The pump assembly of claim 14 wherein the inner gear receives a torque and transmits the torque to the outer gear.

17. The pump assembly of claim 14 further comprising a plurality of connecting members configured to couple the pump assembly to a high pressure pump, and a sealing gasket configured to interface with at least a portion of the high pressure pump and to seal the fluid within the pump assembly.

18. The pump assembly of claim 14 wherein the flexible crescent member comprises a first end, a second end, and a gap within the first end, the gap configured to allow the fluid to flow at least partially within the flexible crescent member.

19. The pump assembly of claim 18 wherein the fluid within the flexible crescent member absorbs at least a portion of heat generated by movement of the inner gear and the outer gear along the flexible crescent member.

20. The pump assembly of claim 14 wherein a first pressure at the inlet is less than a second pressure at the outlet, and the flexible crescent member is configured to at least partially prevent the fluid from flowing from the outlet to the inlet.

* * * * *